United States Patent [19]

MacKay, Jr.

[11] Patent Number: 4,754,578

[45] Date of Patent: Jul. 5, 1988

[54] DISPOSABLE DEPRESSED CENTER GRINDING WHEEL HAVING AN INTEGRAL MOUNTING HUB INCLUDING A PRESSURE CAP

[76] Inventor: Joseph H. MacKay, Jr., 17551 Cabela Dr., San Diego, Calif. 92127

[21] Appl. No.: 5,813

[22] Filed: Jan. 21, 1987

Related U.S. Application Data

[63] Continuation-in-part of Ser. No. 847,793, Apr. 3, 1986, Pat. No. 4,694,615.

[51] Int. Cl.[4] ..... B24B 45/00

[52] U.S. Cl. ..... 51/168; 51/209 R; 51/378; 15/230.18

[58] Field of Search ..... 51/168, 209 R, 358, 51/376, 377, 378, 389; 15/230.18, 230.19

[56] References Cited

U.S. PATENT DOCUMENTS

| | | | |
|---|---|---|---|
| 489,149 | 1/1893 | Hyde | 51/168 |
| 872,932 | 12/1907 | Hall | 51/168 |
| 2,278,301 | 3/1942 | Bauer | 51/209 R |
| 2,633,008 | 3/1953 | Tocci-Guilbert | 51/168 X |
| 3,136,100 | 6/1964 | Robertson | 51/209 R |
| 3,623,281 | 11/1971 | Moffat | 51/377 |
| 3,879,178 | 4/1975 | Bosma | 51/168 |
| 4,015,371 | 4/1977 | Grayston | 51/168 |
| 4,322,920 | 4/1982 | Wells | 51/376 X |
| 4,439,953 | 4/1984 | Block et al. | 51/389 |
| 4,449,329 | 5/1984 | Sauerwein et al. | 51/168 |

*Primary Examiner*—Robert P. Olszewski

*Attorney, Agent, or Firm*—Nilsson, Robbins, Dalgarn, Berliner, Carson & Wurst

[57] ABSTRACT

A disposable depressed center grinding wheel for mounting on a rotatable threaded spindle of a power tool. The grinding wheel contains a retaining nut on one side and a backing flange on the other non-removably secured together on the grinding wheel without the aid of adhesives in such a manner that the grinding wheel is placed in compression when it is operably secured upon the spindle of the power tool under grinding loads. The nut and flange are secured together by upsetting one end of the nut causing it to protrude outwardly over the outer surface of the flange. A pressure cap member is secured to the outwardly protruding portion of the nut for engaging a shoulder formed on the spindle of the power tool during operation of the grinding wheel.

12 Claims, 2 Drawing Sheets

DISPOSABLE DEPRESSED CENTER GRINDING WHEEL HAVING AN INTEGRAL MOUNTING HUB INCLUDING A PRESSURE CAP

RELATED APPLICATION

This application is a continuation-in-part of U.S. patent application Ser. No. 847,793, filed Apr. 8, 1986 now U.S. Pat. No. 4,694,615 for DISPOSABLE DEPRESSED CENTER GRINDING WHEEL HAVING AN INTEGRAL MOUNTING HUB.

FIELD OF THE INVENTION

This invention relates generally to abrasive finishing articles and more particularly to abrasive wheel assemblies having a depressed center abrasive wheel with a mounting hub permanently affixed thereto with the combination adapted for attachment to an appropriate portable power tool.

BACKGROUND OF THE INVENTION

The use of rotatably driven grinding wheels is widespread and familiar in our industrial society. One of the more serious problems encountered in the use of such devices resides in the provision of effective means for preventing undesired or accidental disassociation of the grinding wheel from the shaft, spindle or other rotatable drive means on which it is mounted. This problem is particularly acute when the connection between the grinding wheel and its driving shaft or spindle is intentionally detachable to facilitate quick removal and replacement of the grinding wheel. Into this category fall a host of devices, for example, portable powered grinders wherein the grinding wheels employed are intentionally detachable from the power driven shaft so that they may be readily replaced. To properly mount the grinding wheel upon the shaft provision must be made to provide sufficient clamping force and also to secure the wheel rotationally.

One means of securing the grinding wheel to the drive shaft has been to provide an appropriate backing flange with a central opening which is aligned with an opening provided in the depressed center abrasive grinding wheel. A bolt or nut member (depending upon the configuration of the drive shaft, that is, whether it is externally or internally threaded) is inserted from the face side of the grinding wheel and is then tightened in place. In this manner a plurality of loose parts are configured in a completed assembly ready for use. As the grinding wheel is utilized the appropriate clamping force is provided to securely affix the grinding wheel to the drive shaft. Such an assembly, however, typically requires appropriate tools such as wrenches or the like to remove the grinding wheel from the drive shaft. Such a device is shown in U.S. Pat. Nos. 3,596,415; 1,998,919; 566,883; 507,223; 1,162,970; 791,159; 489,149 and 3,210,892.

Subsequently it became desirable to affix the mounting hub permanently to the grinding wheel so that the entire unit may be quickly and easily attached and detached from the drive shaft and discarded when the grinding wheel has been worn down. In these types of devices it is customary to utilize an adhesive such as an epoxy resin or the like between the backing flange and the back surface of the grinding wheel to retain integrity between the mounting hub and the grinding wheel to secure the wheel rotationally.

Even though the adhesive tended to work quite well in most applications, it was discovered that in some instances the adhesive would break loose and the grinding wheel would rotate relative to the mounting hub. Such was particularly the case since the hub was a one-piece member which was internally threaded and held in place upon the grinding wheel by swaging an extension thereof into place, thus providing a fixed clamping force holding the grinding wheel. No additional clamping force was exerted during further rotation of the wheel during use as was the case with the traditional nut which was secured from the face as above described. As a result various keyways and corresponding key structures were developed between the wheel and the mounting hub and used in conjunction with the adhesive to preclude rotational movement between the mounting hub and the grinding wheel. Examples of such devices are shown in U.S. Pat. Nos. 8,136,100; 4,015,371; 2,278,301; 3,081,584; 3,500,592; 3,800,483; 4,240,230 and 4,541,205.

Additional prior art patents known to applicant are U.S. Pat. Nos. 3,041,797; 3,879,178; 1,724,742; 3,912,411; 3,879,178; 3,960,516; 4,026,074; 4,054,425; 4,088,729; 4,601,661; 791,791; 872,932; 2,567,782; 3,136,100, 3,210,892 and 3,621,621.

The devices utilized in the prior art for providing the disposable grinding wheel assembly including the permanent affixed mounting hub generally provide the service intended. There are certain inherent disadvantages found with regard to the various devices. Such disadvantages are that in manufacturing the utilization of an adhesive adds additional labor to the cost of manufacturing. In certain of the devices, parts must be keyed together and properly aligned in order to function appropriately. In addition thereto, through the utilization of die-cast mounting hubs which include as an integral part the backing flange there is no additional clamping force exerted upon the grinding wheel as it is being rotated by the power tool. Furthermore, such die-cast mounting hubs are relatively bulky, take up space and add substantial weight and additional cost to the completed product.

SUMMARY OF THE INVENTION

A finishing article having a drive member non-removably affixed thereto for mounting on a rotatable spindle of a power tool. The drive member includes a backing flange secured by a retaining nut positioned within the depressed center and on the opposite side from the backing flange. The retaining nut extends through an opening in the finishing article from the face toward the back of the finishing article and has a radial flange at one end thereof seated against the finishing article face and protrusion means extending outwardly from the other end thereof for non-removably securing the retaining nut and the backing flange together on the grinding wheel without the use of adhesives. A pressure cap defining a central opening is held in place on the drive means in engagement with the backing flange and extends longitudinally away from the backing flange to engage the power tool spindle for placing the finishing article in compression during use thereof when the finishing article is operatively secured upon the spindle of the power tool.

BRIEF DESCRIPTION OF THE DRAWINGS

FIG. 8 is a cross sectional view of a backing flange constructed in accordance with the present invention;

DETAILED DESCRIPTION

Figure 1:
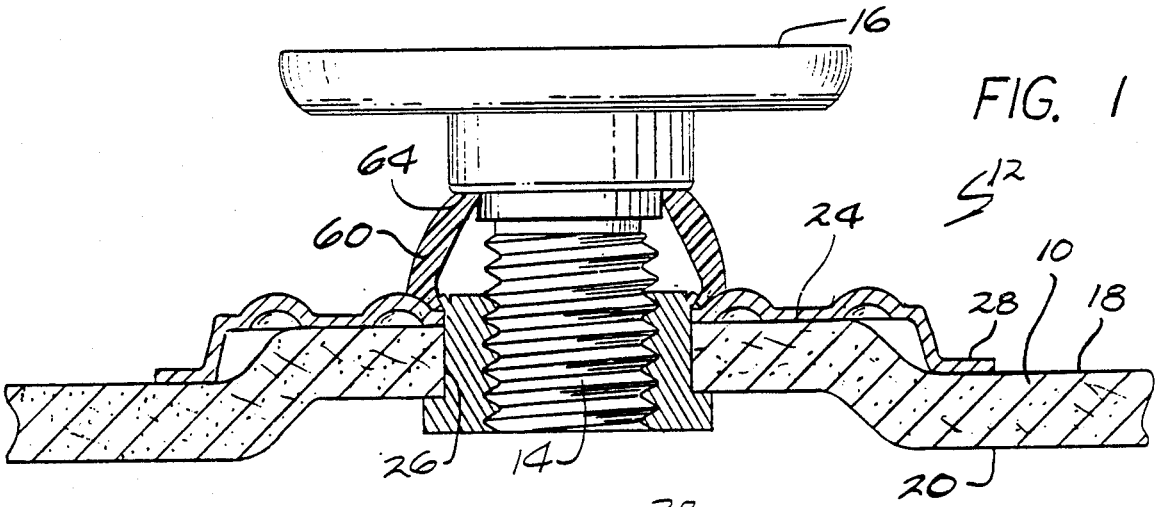
FIG. 1 is a cross sectional view of a disposable grinding wheel assembly constructed in accordance with the principles of the present invention and mounted in operable position on the spindle of a power tool.

By reference now to FIGS. 1 through 6, there is illustrated a preferred embodiment of a disposable grinding wheel-drive member assembly constructed in accordance with the principles of the present invention. As is therein shown a depressed center grinding wheel 1O has a disposable drive member assembly 12 permanently affixed thereto so that the grinding wheel may be attached to the threaded spindle 14 of an appropriate power tool 16. According to the principles of the present invention, a disposable mounting hub or drive member is constructed in such a manner that when the grinding wheel is placed in operation upon the spindle 14 the grinding wheel 10 is placed in compression and the more force which is applied to the grinding wheel during utilization thereof, the greater the operational compression becomes. As a result of placing the grinding wheel in such compression the grinding wheel is maintained upon the spindle and at the same time, through the compression or clamping force, the drive wheel 10 cannot rotate relative to the driving member or hub assembly 12. However, as a result of the construction of the driving member, the spent grinding wheel may be easily removed from the spindle for disposal without the utilization of hand tools or the like.

As is clearly shown, the grinding wheel 10 includes a back surface 18 and a front surface 20. The central portion of the grinding wheel is depressed as viewed from the front thereof and as is shown at 22, with a corresponding central raised portion 24 on the back thereof. A centrally located aperture 26 is provided in the depressed center portion of the grinding wheel 10. The purpose of the depressed center of the grinding wheel 10 is to insure that the driving member or spindle does not protrude beyond the face portion 20 of the wheel 10 and thus interfere with a workpiece during the time the grinding wheel 10 is being utilized.

A backing flange 28 is provided and is adapted to be snugly received on the back surface 18 of the grinding wheel 10 about the raised portion 24. The flange 28 has a diameter which is less than the diameter of the wheel 10. The backing flange 28 defines a second central aperture 30 therethrough which is aligned with the aperture 26 in the grinding wheel 10. A pair of reinforcing ribs 32 and 34 are formed in the backing flange 28 concentrically with the opening 30. The backing flange 28 is preferably stamped from sheet metal but of course could be constructed from other materials such as hard molded plastic or die cast metal should such be desired.

Figure 2:
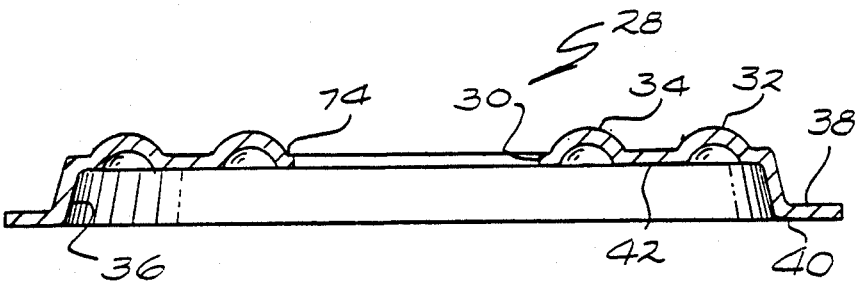
FIG. 2 is an exploded view of the structure as illustrated in FIG. 7.

As is shown more specifically in FIG. 2, the backing flange 28 includes an inner surface 36 and an outer surface 38. The inner surface 36 is disposed opposed the back surface 18 of the abrasive finishing wheel 10. The inner surface 36 includes a pair of lands 40 and 42. The land 40 is formed about the outer peripheral portion of the backing flange 28. The land 42 is displaced inwardly toward the opening 30 and away from the land 40. The land 40 always engages the back surface 18 of the abrasive finishing wheel away from the depressed center while the land 42 may engage the back surface of the abrasive finishing wheel 10 opposed the depressed center 22 thereof depending upon variations in wheel dimensions and manufacturing tolerances in the wheels and flanges.

Figure 3:
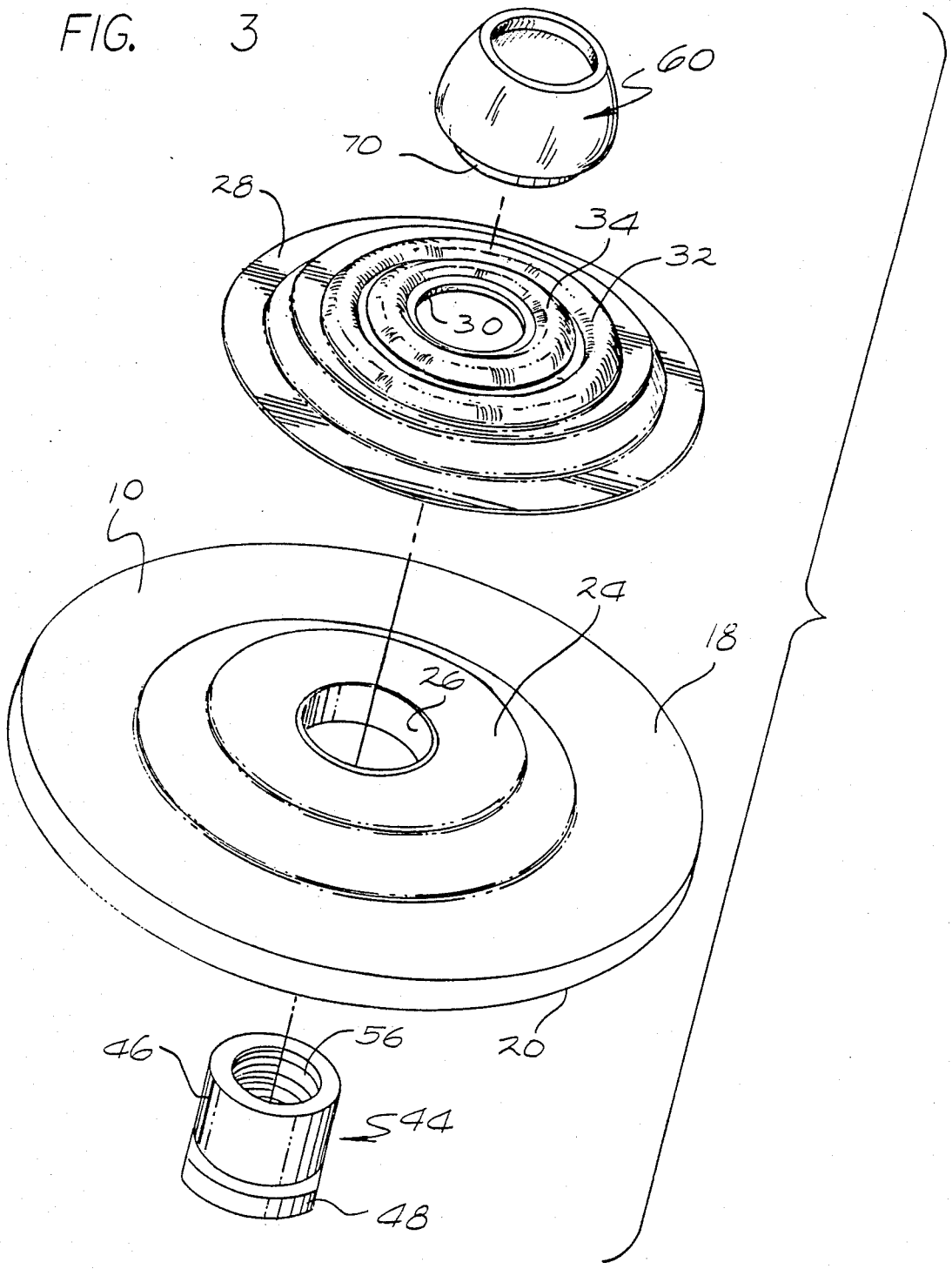

As can be seen, particularly in FIG. 3, the ribs 32 and 34 formed in the outer surface 38 of the backing flange 22 are continuous. The continuous rib 32 is disposed between the lands 40 and 42 and over the transitional area between the depressed center and the remainder of the grinding wheel 10 while the continuous rib 34 is disposed intermediate the opening 30 and the land 42.

Figure 4:
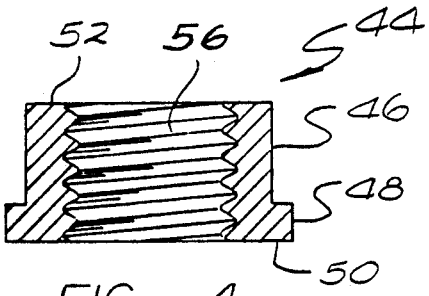
FIG. 4 is a cross section view of a retaining nut constructed in accordance with the principles of the present invention.

As shown in FIG. 4, a retainer nut 44 includes a body portion 46 which is hollow and has a radially outwardly extending flange 48 at a first end 50 thereof. The internal surface of the body 46 has threads 56 formed therealong for attachment to the threaded spindle 14 of the power tool. The nut 44 is inserted through the aperture 26 in the grinding wheel and the aperture 30 in the flange 28 from the front surface 20 toward the rear surface 18 of the grinding wheel 10. The end 52 of the nut 44 extends through the opening 30 in the flange 28.

The nut 44 is preferably constructed from an aluminum extrusion which is then machined to provide the flange 38 and the threads 46. Alternatively the nut may be formed from aluminum or steel bar stock, or a metal die casting.

Figure 5:
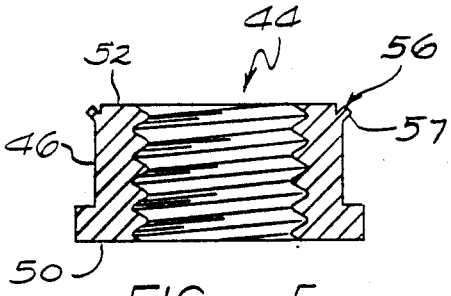
FIG. 5 is a cross sectional view of the retaining nut of FIG. 5 after being upset.
Figure 6:
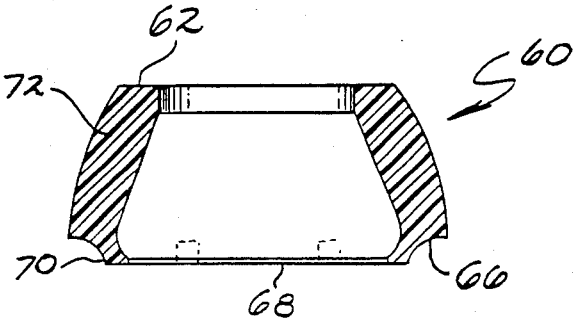
FIG. 6 is a cross sectional view showing construction of the pressure cap constructed in accordance with the present invention.

Once the nut 44 has been inserted through the openings in the wheel 10 and the flange 28, the end 52 thereof is upset such as by a staking operation to provide a protrusion 56 extending outwardly therefrom as shown specifically in FIG. 5. The protrusion may be formed as a series of separate protrusions, or, as shown, as a continuous protrusion. In any event, protrusion 56 extends outwardly from the body 46 in such a manner as to engage the flange 28 about the outer surface 38 thereof adjacent the opening 30 therethrough. It should become apparent to those skilled in the art that the flange 28 and the nut 44 are secured together on the wheel 10 between the flange 48 and the protrusion 56 without the use of adhesives.

Preferably the protrusion is formed by a staking operation which forms a continuous groove 54 in the end 52 of the nut 44. Formation of the groove 54 causes the displaced material to form a lip or overhang 57 which will overlie the back of the backing flange 28 about the opening 30 therethrough.

To provide proper operational compressive forces of the throwaway grinding wheel as above-described, a pressure cap 60 is snapped into locking engagement with the hub assembly 12. The pressure cap includes a first or rear surface 62 for engaging a surface 64 on the power tool spindle when the grinding wheel is in an operable position on the power tool 16. A second or front surface 66 on the pressure cap 60 contacts the top of the continuous rib 34. The pressure cap 60 is retained in position on the hub assembly 12 by a gripping rib 68 which extends radially inwardly from a downwardly depending skirt 70 on the front surface 66 of the body 72 of the pressure cap 60. The gripping rib 68 snaps over the protrusion 56 and engages the lip 57 on the end 52 of the retainer nut 44. At the same time the surface 74 on the continuous reinforcing rib 34 of the backing flange 28 applies a radially inwardly directed force to secure the gripping rib 68 in place in the space between the lip 57 and the periphery of the backing flange surrounding the opening 30. Preferably the pressure cap 60 is constructed of molded plastic such as polypropylene, polyamide, acetal or the like. The gripping rib 68 may be continuous or intermittent as desired as illustrated by the dashed lines 69. An important feature is that the pressure cap may be easily snapped into locking position as shown in FIG. 1 by the distributor or user before use if desired or, alternatively, at the time of assembly in the factory. Such capability saves space in shipment in that the assembled wheel without the pressure cap may be packed in containers with pressure caps placed in interstices between wheels or wheels and the container. Thus a greater number of wheels may be packaged, on top of each other, in the same container.

It will also be recognized that the pressure cap 60, once installed, remains on the grinding wheel and is disposed of along with the spent wheel.

The force necessary to cause the grinding wheel 10 to be placed in compression is generated upon attachment of the spindle 14 to the threads 56 in the nut 44. By reference to FIG. 1 it will be noted that when the grinding wheel is threaded upon the spindle 14 the surface 62 engages the surface 64, the spindle and the flange 28 through the contact between the surface 66 and the reinforcing rib 34 is forced in a downward direction. At the same time the interengagement between the threads 14 and 56 of the spindle and nut, respectively, urge the nut upward toward the flange 28 to cause the grinding wheel to be placed in compression. Those skilled in the art will recognize that as the grinding wheel 10 is used by being placed against a workpiece additional torque is applied causing the grinding wheel to be further tightened onto the spindle 14. That is, as the grinding wheel moves during contact with a workpiece, the friction between the nut and the grinding wheel center causes the nut to rotate in a further tightening direction. Such rotation of the nut further urges the nut toward the flange which in turn applies a further force to the flange. The more the grinding wheel is tightened the greater the operational compression force becomes and the more securely the grinding wheel 10 is clamped between the backing flange 28 and the flange 48 on the nut 44. As a result of this strong clamping or compression the grinding wheel 10 is precluded from movement relative to the hub or driving member 12 and at the same time is precluded from disengaging from the spindle 14.

It will be recognized by those skilled in the art that the grinding wheel assembly as illustrated in FIGS. 1 through 6 and as above described requires no adhesive for construction and may be simply and easily assembled, is relatively light in weight as compared to the prior art devices utilizing the cast hubs and provides a secure attachment of the grinding wheel to the power tool and through the utilization of the increased compression precludes relative rotation of the grinding wheel with respect to the driving member. It has also been discovered that the utilization of the device as above described and as constructed in the preferred embodiment is extremely smooth in operation with no vibration. The reason for such extremely smooth operation is that all of the parts are perfectly aligned one with the other with the abutting surfaces parallel when in compression and only the wheel 10 can cause any vibration and then only if it is not properly balanced during the construction thereof.

Through the structures as illustrated and described, all currently known sizes of standard diameter depressed center grinding wheels, namely four inch, four and one half inch, five inch, seven inch and nine inch may be accommodated. At the present time, through the utilization of the die-cast integral hub-flange structure, only seven and nine inch grinding wheels utilize the throw away hub while the four, four and one half and five inch wheel utilize the conventional two-piece mounting set traditional in the prior art and as above described.

There has thus been disclosed a disposable grinding wheel-driving member assembly which securely holds the grinding wheel during operation, which is light in weight, vibration-free, and less expensive than prior art throw-away grinding wheels while meeting all safety standards currently known and in existence.

What is claimed is:

1. A disposable finishing article having a disposable drive member non-removably affixed thereto for mounting on a threaded rotatable spindle of a power tool comprising:

a finishing article having a face and a back and having a first centrally disposed aperture therethrough;

a backing flange having a diameter smaller than the diameter of said finishing article and defining a second centrally disposed aperture therethrough, said backing flange seated on said back of said finishing article with said first and second apertures aligned;

a retaining nut having a hollow internally threaded body having first and second ends and a first radially outwardly extending flange extending from said first end of said body, said body extending through said first and second apertures from said face toward said back of said finishing articles with said radial flange seated against said face;

means protruding ouwardly form said second end of said body to non-removably secure said retaining nut and said backing flange together on said finishing article without the use of adhesives and allowing relative axial movement between said retaining nut and said backing flange; and a molded plastic pressure cap means defining a centrally disposed opening therethrough secured to said drive member in engagement with said backing flange to apply force to said backing flange when said finishing article is secured on said spindle to cause said backing flange and said retaining nut to move toward each other to compress said finishing article therebetween as operative loads are applied to said article during use on said power tool.

2. A disposable finishing article as defined in claim 1 wherein said outwardly protruding means includes at least a portion of said second end of said body.

3. A disposable finishing article as defined in claim 2 wherein said outwardly protruding portion of said body includes a continuous ring seated against said backing flange and defining a lip.

4. A disposable finishing article as defined in claim 3 wherein said second end of said body is upset to provide said continuous ring.

5. A disposable finishing article as defined in claim 3 wherein said backing flange has an inner and an outer surface and wherein said outer surface of said backing flange includes a continuous reinforcing rib extending therefrom; said pressure cap engaging said continuous rib.

6. A disposable finishing article as defined in claim 5 wherein said pressure cap includes means for gripping said lip and said rib urges said gripping means toward said lip as said pressure cap is secured in place on said finishing article.

7. A disposable finishing article having a disposable drive member non-removably affixed thereto for mounting on a threaded rotatable spindle of a power tool comprising:

a finishing article having a face and a back and having a first centrally disposed aperture therethrough;

a backing flange having a diameter smaller than the diameter of said finishing article and defining a second centrally disposed aperture therethrough, said backing flange seated on said back of said finishing article with said first and second apertures aligned;

a retaining nut having a hollow internally threaded body having first and second ends and a first radially outwardly extending flange extending from said first end of said body, said body extending through said first and second apertures from said face toward said back of said finishing article with said radial flange seated against said face;

a continuous ring defining a lip protruding outwardly from said second end of said body and seated against said backing flange to non-removably secure said retaining nut and said backing flange together on said finishing article without the use of adhesives; and pressure cap means defining a centrally disposed opening therethrough and means for gripping said lip to secure said pressure cap to said finishing article to apply force to said backing flange when said finishing article is secured on said spindle to cause said backing flange and said retaining nut to move toward each other to compress said finising article therebetween as operative loads are applied to said article during use on said power tool.

8. A disposable finishing article as defined in claim 7 wherein said means for gripping includes a radially inwardly directed member.

9. A disposable finishing article as defined in claim 8 wherein said pressure cap further includes a cap body having a downwardly depending skirt terminating in said gripping means.

10. A disposable finishing article as defined in claim 9 wherein said cap body includes a first surface for engaging said spindle and a second surface for engaging said backing flange when said pressure cap is secured to said finishing article.

11. A disposable finishing article as defined in claim 10 wherein said backing flange has an inner and an outer surface and wherein said outer surface of said backing flange includes a continuous reinforcing rib extending therefrom and wherein said second surface engages said reinforcing rib.

12. A disposable finishing article as defined in claim 11 wherein said reinforcing rib is disposed adjacent and surrounding said outwardly protruding portion of said retainer nut and said gripping means is disposed between said engagement with said rib and said outwardly protruding portion.

* * * * *